US007527184B2

(12) United States Patent
Shao

(10) Patent No.: US 7,527,184 B2
(45) Date of Patent: May 5, 2009

(54) SAFETY STRUCTURE OF NAIL GUN

(76) Inventor: Mao-Hsuan Shao, No.855, Yongchun E. Rd., Nantun District, Taichung City 408 (TW)

( * ) Notice: Subject to any disclaimer, the term of this patent is extended or adjusted under 35 U.S.C. 154(b) by 0 days.

(21) Appl. No.: 11/785,152

(22) Filed: Apr. 16, 2007

(65) Prior Publication Data

US 2008/0237291 A1 Oct. 2, 2008

(51) Int. Cl.
*B25C 1/04* (2006.01)

(52) U.S. Cl. ..... 227/8; 227/120; 227/130; 227/142

(58) Field of Classification Search ..... 227/8, 227/120, 130, 142
See application file for complete search history.

(56) References Cited

U.S. PATENT DOCUMENTS 3,612,379 A * 10/1971 Panock ..... 227/8
4,629,106 A * 12/1986 Howard et al. ..... 227/8
5,193,730 A * 3/1993 Tanaka et al. ..... 227/8
5,485,946 A * 1/1996 Jankel ..... 227/8
5,791,545 A * 8/1998 Lin ..... 227/8
5,836,501 A * 11/1998 Lai ..... 227/8
6,357,647 B1 * 3/2002 Ou ..... 227/8
6,450,387 B1 * 9/2002 Chen ..... 227/8
6,866,177 B1 * 3/2005 Chen ..... 227/142
6,886,729 B1 * 5/2005 Lee ..... 227/8
6,929,165 B1 * 8/2005 Chen et al. ..... 227/8
6,953,137 B2 * 10/2005 Nakano et al. ..... 227/8
7,191,927 B2 * 3/2007 Segura ..... 227/8
7,308,995 B2 * 12/2007 Uchiyama et al. ..... 227/8
7,322,426 B2 * 1/2008 Aguirre et al. ..... 173/1

* cited by examiner

*Primary Examiner*—Louis K. Huynh
*Assistant Examiner*—Michelle Lopez
(74) *Attorney, Agent, or Firm*—Browdy and Neimark P.L.L.C.

(57) ABSTRACT

A safety structure of a nail gun includes a trigger set including a trigger and a plate. The trigger is pivoted on a main frame to be moved toward a trigger device. The plate is pivoted on the trigger between the trigger and the trigger device. A linkage is pivoted on the main frame to press a free end of the plate. A spring urges the linkage to move back the linkage when the linkage is moved away from the trigger. A tappet is pivoted on the main frame to be moved by the linkage. An arm is on the muzzle for reciprocation, which has an extending portion extending to a front of the trigger. A cover is pivoted on the extending portion of the arm and covers the tappet and the linkage. The linkage leans on the cover so that the cover is moved by the linkage.

7 Claims, 5 Drawing Sheets

SAFETY STRUCTURE OF NAIL GUN

BACKGROUND OF THE INVENTION

1. Field of the Invention

The present invention relates generally to a nail gun, and more particularly to a safety structure of a nail gun.

2. Description of the Related Art

Typically, to prevent a nail gun from being triggered unexpectedly to hurt somebody, the nail guns are equipped with a safety for protection of user and people around.

SUMMARY OF THE INVENTION

The primary objective of the present invention is to provide a safety structure of a nail gun, which has a safety may be moved backwardly to expose a tip of a nail for aiming a target.

According to the objective of the present invention, a safety structure of a nail gun includes a trigger set including a trigger and a plate. The trigger is pivoted on a main frame of the nail gun to be moved toward the trigger device. The plate is pivoted on the trigger between the trigger and the trigger device. A linkage is pivoted on the main frame to press a free end of the plate. A spring urges the linkage to move back the linkage when the linkage is moved away from the trigger. A tappet is pivoted on the main frame to be moved by the linkage. An arm is on the muzzle for reciprocation, which has an extending portion extending to a front of the trigger. A cover is pivoted on the extending portion of the arm and covers the tappet and the linkage. The linkage leans on the cover so that the cover is moved by the linkage.

DETAILED DESCRIPTION OF THE INVENTION

Figure 1:
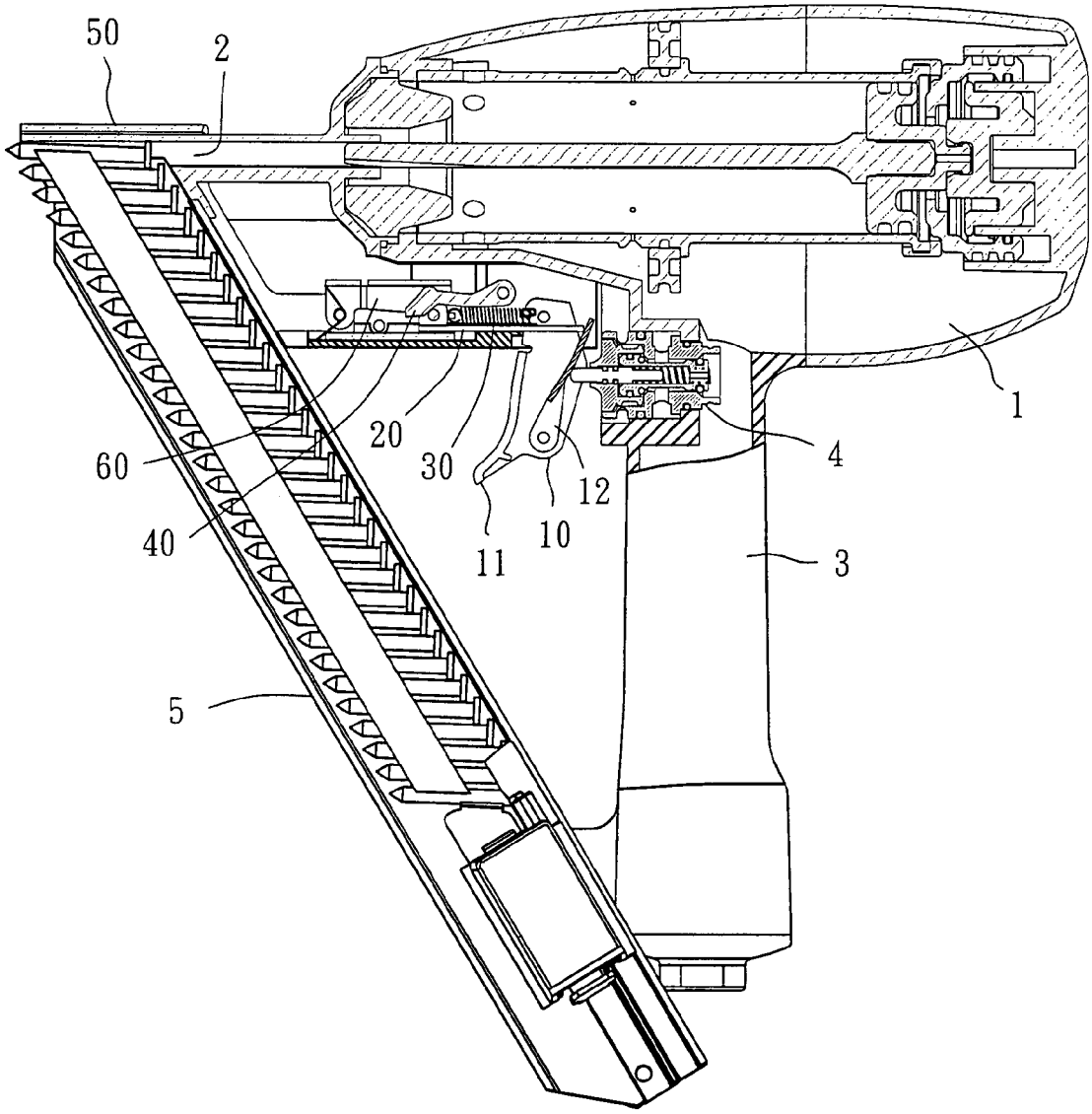
FIG. 1 is a sectional view of a preferred embodiment of the present invention.
Figure 2:
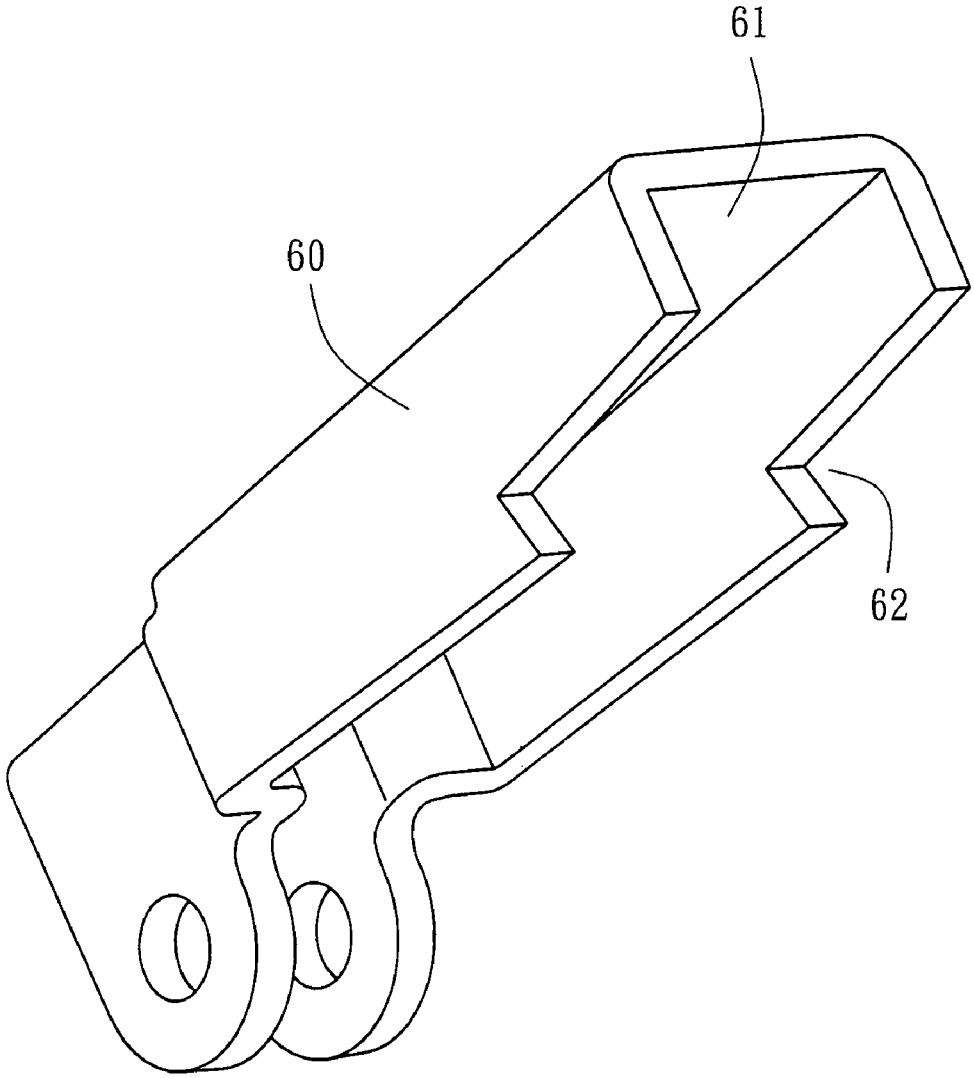
FIG. 2 is a perspective view of the tappet of the preferred embodiment of the present invention.
Figure 3:
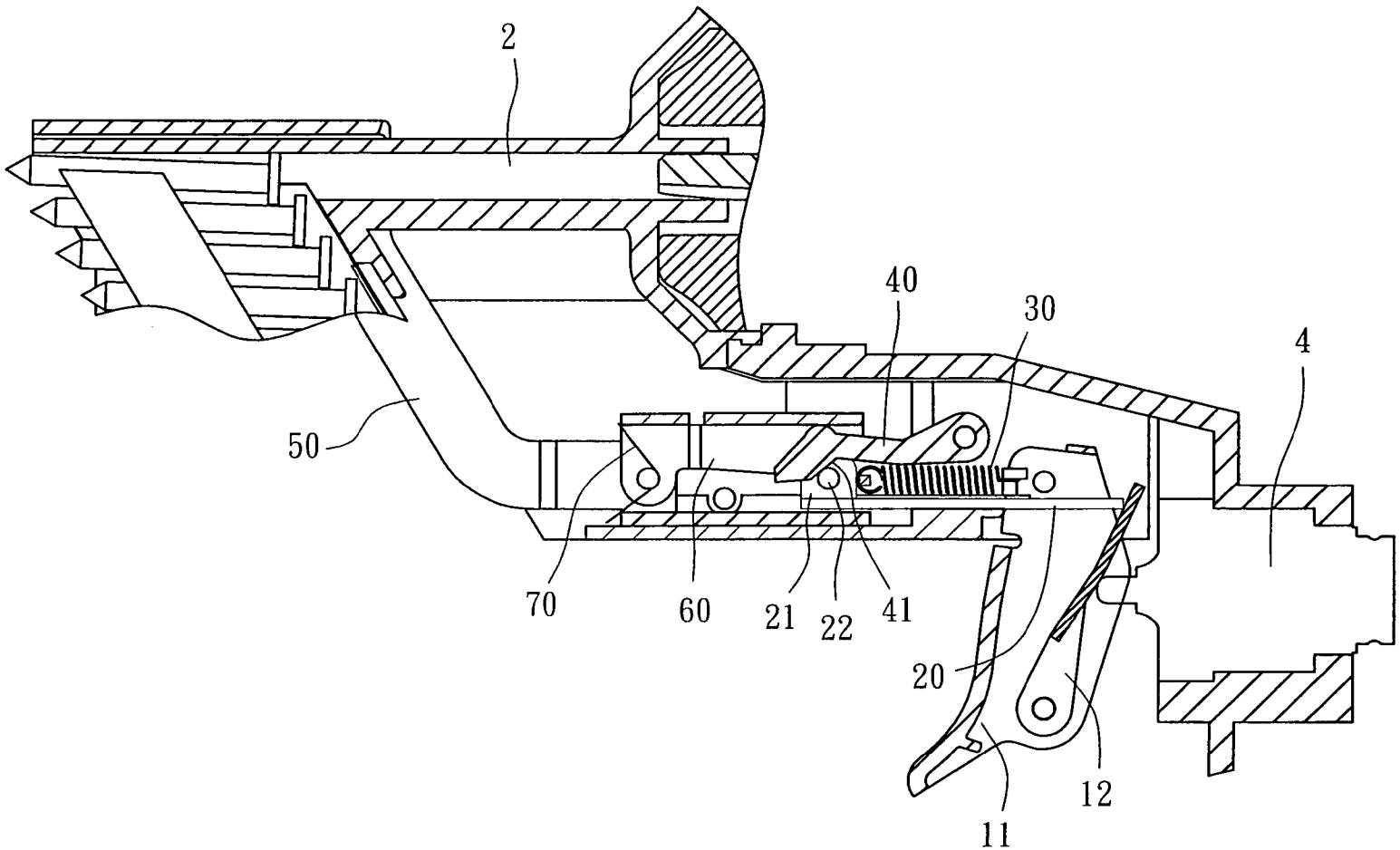
FIG. 3 is an enlarged view of the trigger set of the preferred embodiment of the present invention.

As shown in FIG. 1 to FIG. 3, a safety structure of the present invention is mounted on a conventional power or pneumatic nail gun. The nail gun includes a main frame 1, which has a muzzle 2, a handle 3, a trigger device 4 and a magazine 5. The safety structure of the present invention includes:

A trigger set 10 includes a trigger 11 and a plate 12. The trigger 11 has an end nearby the trigger device 4 which can be swung toward the trigger device 4. The plate 12 has an end pivoted on the trigger 11 wherein the plate 12 is located between the trigger 11 and the trigger device 4.

As shown in FIG. 3, a linkage 20 has an end which abuts against a free end of the plate 12 and another end with a protrusion 21 and two posts 22 beside the protrusion 21. The linkage 20 is engaged on the main frame 1 nearby the trigger 11 so it can be moved toward the trigger 11 or away from the trigger 11.

A spring 30 has an end mounted on the main frame 1 and the other end fitted to the protrusion 21 of the linkage 20 so that the linkage will be moved back by the spring 30 after it is moved away from the trigger 11.

A tappet 40 has an end pivoted on the main frame 1 and another end with an inclined portion 41. The inclined portion 41 is engaged on the linkage 20 to permit the posts 22 to push the inclined portion 41 and swing tappet 40.

An arm 50 is engaged around the muzzle 2 for reciprocation along the muzzle 2. The arm 50 has an extending portion extending to a front of the trigger 11.

A cover 60 has an end pivoted on the extending portion of the arm 50 and a free end with a chamber 61. The tappet 40 and the linkage 20 are received in the chamber 61 wherein the tappet 40 is located between the linkage 20 and the cover 60. The cover 60 has two gaps 62 on opposite sides of the chamber 61 to receive the posts 22 of the linkage 20 therein when the cover 60 covers the tappet 40 and the linkage 20.

An elastic member 70 is mounted on a proximal end of the cover 60 to urge the cover 60 to normally cover the tappet 40 and the linkage 20.

Figure 4:
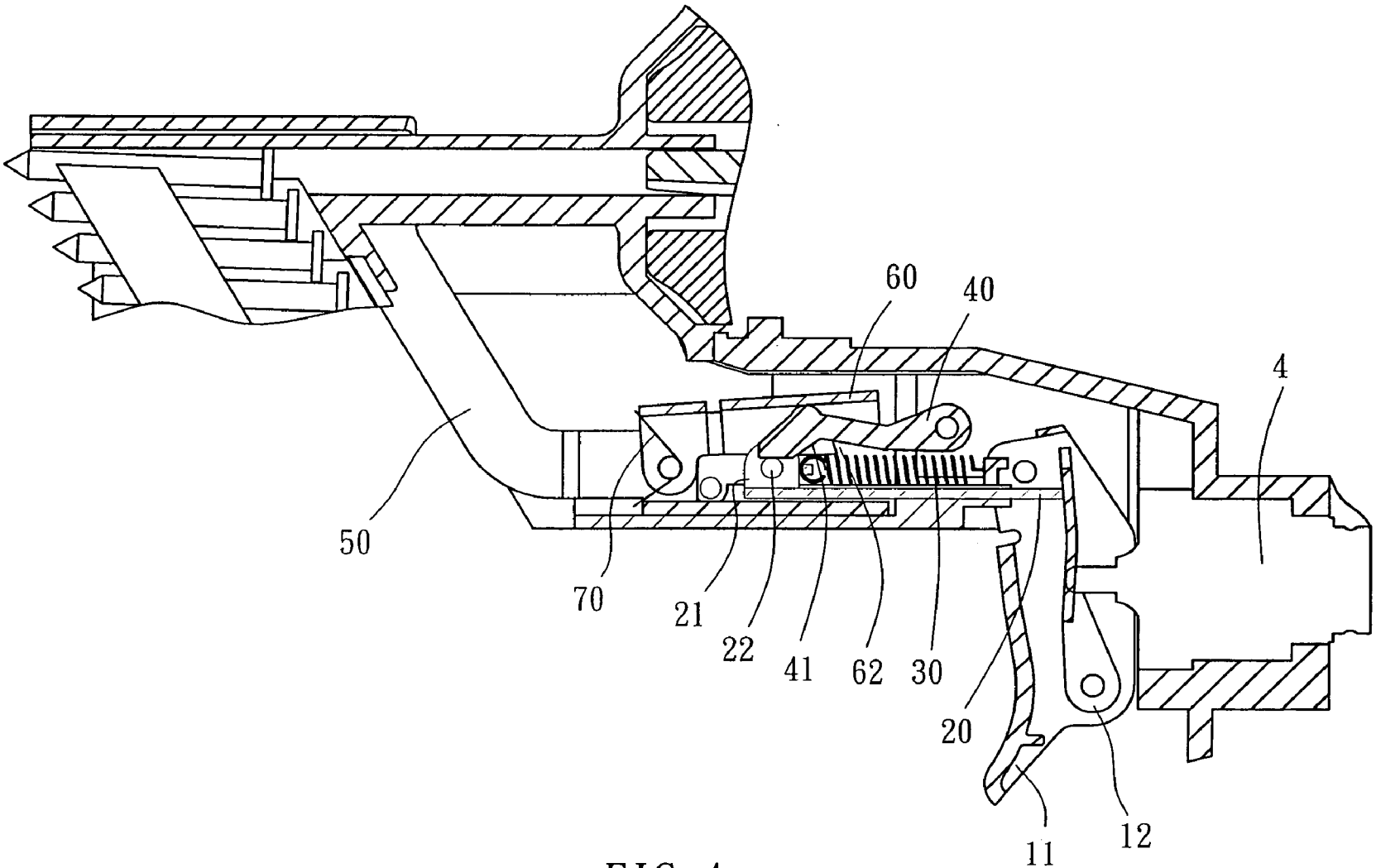
FIG. 4 is similar to FIG. 3, showing the unpercussion condition.

With the structure described above, there are two conditions in operation of the present invention. First condition is an unpercussion condition. As shown in FIG. 3 and FIG. 4, when the muzzle 2 of the nail gun is not pressed on an object, the trigger 11 of the trigger set 10 is moved toward the trigger device 4 together with the plate 12 to press the trigger device 4, and the free end of the plate 12 is moved away from the trigger device 4 to move the linkage 20 forward. After the linkage 20 is moved, the linkage 20 will pull the spring 30 and push the inclined portion 41 of the tappet 40 by the posts 22 to move the tappet upwardly that will move the cover 60 outwardly to move the linkage 20 freely. As a result, the plate 12 having not enough pressure to activate the trigger device 4 and the nail gun will not fire a nail.

Figure 5:
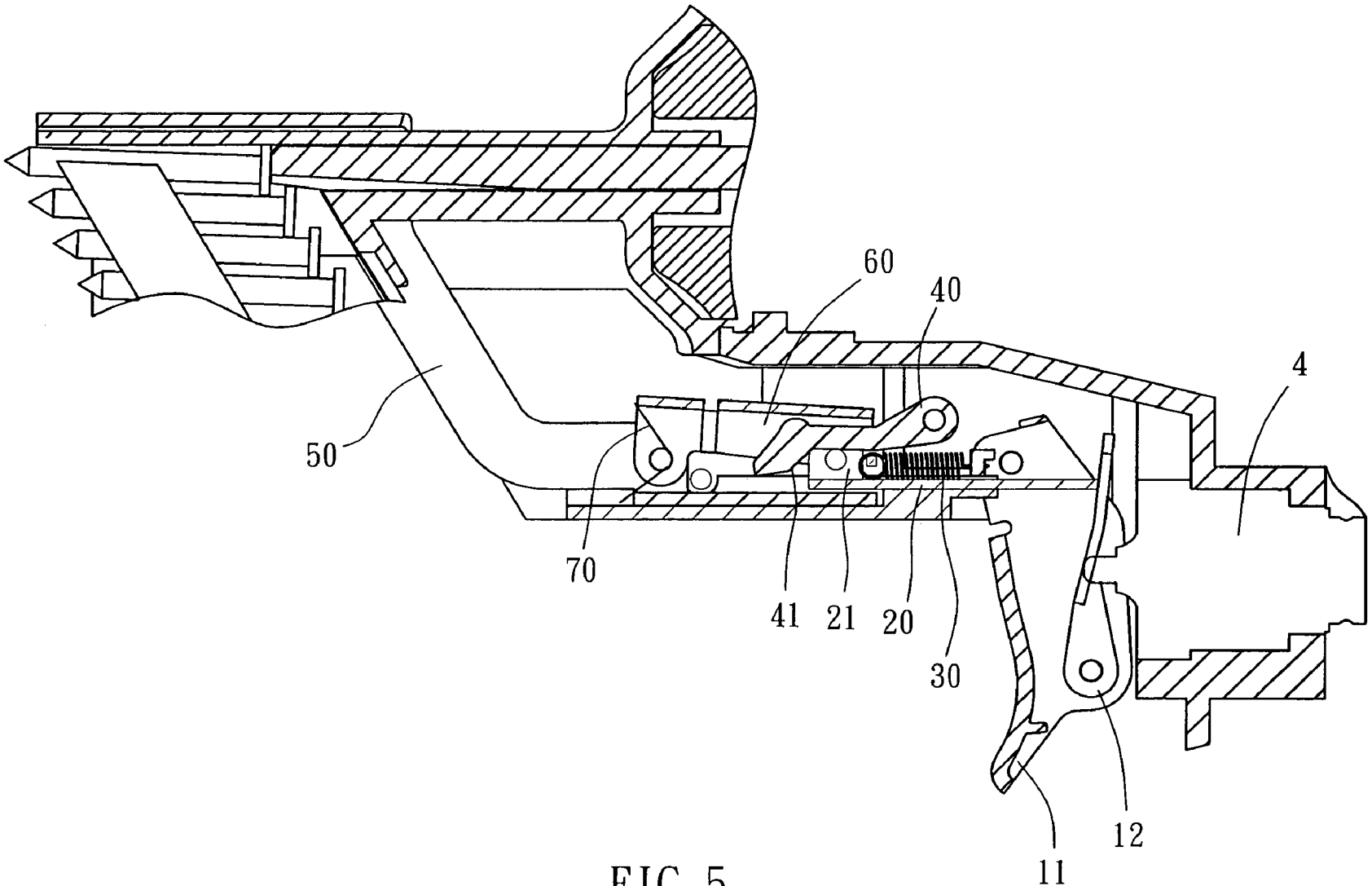
FIG. 5 is similar to FIG. 3, showing the percussion condition.

The second condition is a percussion condition. As shown in FIG. 3 and FIG. 5, when user presses the muzzle 2 of the nail gun on an object, the arm 50 is move backwardly. The trigger 11 of the trigger set 10 is moved toward the trigger device 4 together with the plate 12 and the free end of the plate 12 will be moved away from the trigger device 4 by the trigger device 4 to move the linkage 20 forward. In the same time, because the arm 50 and the cover 60 are moved backwardly, the posts 22 of the linkage 20 will be in the gap and engage the cover 60. Further because the arm 50 is pressed by the object and can not be moved anymore, the cover 60 also can not be moved, so that the tappet 40 will not be moved away by the posts 22 of the linkage 20, and the cover 60 will not be moved away by the tappet 40. Accordingly, the plate 12 has enough pressure to press the trigger device 4 because the trigger 11 keeps being pressed. As a result, a tip of a nail will be exposed to aim the object that may prevent user from hurt because the nail gun is not touching the object and triggered unexpectedly.

The description above is a few preferred embodiments of the present invention and the equivalence of the present invention is still in the scope of the claim of the present invention.

What is claimed is:

1. A safety structure of a nail gun, wherein the nail gun includes a main frame with a muzzle, a handle, a trigger device and a magazine, comprising:

a trigger set including a trigger and a plate, wherein the trigger has an end pivoted on the main frame movable toward the trigger device, and the plate has a first end pivoted on the trigger and is located between the trigger and the trigger device;

a linkage slidably engaged on the main frame and having an end pressing a second free end of the plate movable toward or away from the trigger;

a spring having an end provided on the main frame and the other end urging the linkage to move back the linkage when the linkage is moved away from the trigger;

an arm provided on the main frame on the muzzle for slidable reciprocation along the muzzle, which has an extended portion extending toward a front of the trigger;

a tappet having a first end pivoted on the main frame, and a second free end movably engaged on a cover;

therein the cover has a first end pivoted on the extended portion of the arm and a second free end covering the tappet and the linkage, wherein the tappet is located between the linkage and the cover and engages and moves the cover when the arm is not pressed against an object and the trigger is moved toward the trigger device so as to move the linkage and tappet away from the trigger device so that the trigger does not actuate the nail gun, and wherein the tappet does not engage and move the cover when the arm is pressed against an object so that the trigger does actuate the nail gun.

2. The safety structure of the nail gun as defined in claim 1, wherein the linkage has a protrusion and at least one post to lean on the cover on an end thereof opposite to the end thereof pressing the plate.

3. The safety structure of the nail gun as defined in claim 2, wherein the cover has a gap to receive the post when the cover covers the tappet and the linkage.

4. The safety structure of the nail gun as defined in claim 3, wherein the cover has a chamber on the free end, and the gap is communicated with the chamber to receive the post of the linkage when the cover covers the tappet and the linkage.

5. The safety structure of the nail gun as defined in claim 4, wherein the tappet is received in the chamber of the cover when the cover covers the tappet and the linkage, and the post of the linkage is extended out of the chamber and received in the gap.

6. The safety structure of the nail gun as defined in claim 3, further comprising an elastic member to urge the cover to normally cover the tappet and the linkage.

7. The safety structure of the nail gun as defined in claim 1, wherein the tappet includes an inclined portion engaged on the linkage to make the tappet swing when the linkage is moved.

* * * * *